US006739107B1

(12) United States Patent
Lewis et al.

(10) Patent No.: US 6,739,107 B1
(45) Date of Patent: May 25, 2004

(54) METHOD AND APPARATUS FOR COMPRESSING A MATTRESS WITH AN INNER COIL SPRING

(75) Inventors: Nels V. Lewis, Portland, OR (US); Gary C. Harding, Archer, FL (US)

(73) Assignee: Paramount Bedding, Inc., Damascus, OR (US)

( * ) Notice: Subject to any disclaimer, the term of this patent is extended or adjusted under 35 U.S.C. 154(b) by 37 days.

(21) Appl. No.: 09/793,280

(22) Filed: Feb. 28, 2001

(51) Int. Cl.[7] ..... B65B 63/04; B65H 75/02

(52) U.S. Cl. ..... 53/118; 53/116; 53/510; 53/523; 53/529; 242/541.5; 242/541.6

(58) Field of Search ..... 53/510, 116, 118, 53/523, 529; 242/541.5, 541.6, 547, 918, 908

(56) References Cited

U.S. PATENT DOCUMENTS

| | | | | |
|---|---|---|---|---|
| 2,779,034 A | | 1/1957 | Arpin | |
| 3,458,966 A | * | 8/1969 | Dunbar et al. | 53/430 |
| 3,521,424 A | * | 7/1970 | Wirfel | 53/419 |
| 3,658,273 A | * | 4/1972 | Chapuis | 242/532 |
| 3,935,048 A | | 1/1976 | Rucker | |
| 3,935,690 A | | 2/1976 | Lea et al. | |
| 3,942,299 A | | 3/1976 | Bory | |
| 3,943,686 A | | 3/1976 | Crawford et al. | |
| 3,946,929 A | | 3/1976 | Armetti | |
| 3,958,390 A | | 5/1976 | Pringle, Jr. et al. | |
| 3,964,232 A | | 6/1976 | Bender et al. | |
| 3,964,235 A | | 6/1976 | Miller et al. | |
| 3,967,433 A | | 7/1976 | Bonfiglioli | |
| 3,972,153 A | | 8/1976 | Kiellarson et al. | |
| 3,973,372 A | | 8/1976 | Omori | |
| 3,977,153 A | | 8/1976 | Schrenk | |
| 3,986,921 A | | 10/1976 | Putnam, Jr. et al. | |
| 4,031,815 A | | 6/1977 | Verbeke | |
| 4,040,237 A | | 8/1977 | O'Brien | |
| 4,043,098 A | | 8/1977 | Putnam, Jr. et al. | |
| 4,079,574 A | | 3/1978 | Monguzzi et al. | |
| 4,084,390 A | | 4/1978 | Schmachtel et al. | |

(List continued on next page.)

OTHER PUBLICATIONS

The cover letter accompanying this PTO Form 1449 and the information set forth therein.

Sleeper Cab Bedding brochure, published more than one year before the filing date of the present application.

*Primary Examiner*—Rinaldi I. Rada
*Assistant Examiner*—Brian D Nash
(74) *Attorney, Agent, or Firm*—Klarquist Sparkman, LLP

(57) ABSTRACT

An apparatus for packaging resiliently compressible articles is disclosed. In one embodiment, the apparatus has at least two rotatable, spaced apart article engaging elements adapted to receive an end portion of an article for rolling the article into a compact rolled up configuration. Each article engaging element can be rotatably mounted to one of at least two arm portions, which are desirably pivotally mounted to the apparatus. At least one of the arm portions can be adapted to be movable in a lateral direction. The apparatus may also be provided with a vacuum hose fluidly connected to a vacuum source for vacuum packing an article desirably before it is rolled-up. A spring containing mattress is also disclosed, which, in one embodiment, comprises plural rows of springs and substantially C-shaped border wires extending around the periphery of the end portions of the upper and lower surfaces of the mattress.

23 Claims, 9 Drawing Sheets

U.S. PATENT DOCUMENTS 4,098,404 A 7/1978 Markert
4,106,262 A 8/1978 Aterianus
4,106,265 A 8/1978 Aterianus
4,110,954 A 9/1978 Olsson et al.
4,114,530 A 9/1978 Miller
4,128,985 A 12/1978 Simmons
4,134,245 A 1/1979 Stella
4,144,693 A 3/1979 Ogata
4,144,697 A 3/1979 Suga
4,164,177 A 8/1979 Canfield
4,165,594 A 8/1979 Corbic
4,167,435 A 9/1979 Olschewski
4,171,605 A 10/1979 Putnam, Jr. et al.
4,180,256 A 12/1979 Coast
4,183,193 A 1/1980 Klingelhofer et al.
4,183,515 A 1/1980 Coast
4,190,146 A 2/1980 Knuchel
4,195,723 A 4/1980 Loewenthal
4,223,508 A 9/1980 Wells
4,223,512 A 9/1980 Buchner
4,245,829 A 1/1981 Coast
4,251,975 A 2/1981 Krein
4,287,702 A 9/1981 Corbic
4,288,965 A 9/1981 James
4,291,460 A 9/1981 Stoehr
4,295,922 A 10/1981 Evers
4,328,655 A 5/1982 Spencer et al.
4,355,712 A 10/1982 Bruno
4,372,097 A 2/1983 Wyslotsky
4,381,637 A 5/1983 Ballestrazzi et al.
4,391,081 A 7/1983 Kovacs
4,418,513 A 12/1983 Plahm
4,418,514 A 12/1983 Spann
4,424,659 A 1/1984 Perigo et al.
4,445,241 A 5/1984 Ender et al.
4,483,125 A 11/1984 Suga
4,525,977 A 7/1985 Matt
4,532,753 A 8/1985 Kovacs
4,537,016 A 8/1985 Shanklin et al.
4,549,386 A 10/1985 Wilson
4,561,925 A 12/1985 Skerjanec et al.
4,563,862 A 1/1986 McElvy
4,592,193 A 6/1986 Gustavsson
4,602,472 A * 7/1986 Ampolini et al. ..... 53/438
4,631,899 A 12/1986 Nielsen
4,633,654 A 1/1987 Sato et al.
4,711,067 A 12/1987 Magni
4,727,707 A 3/1988 Hadden
4,757,668 A 7/1988 Klinkel et al.
4,964,259 A 10/1990 Ylvisaker et al.
5,062,172 A 11/1991 Stewart
5,177,935 A 1/1993 Jones et al.
5,775,059 A * 7/1998 Hampton et al. ..... 53/429
5,934,041 A 8/1999 Rudolf et al.
6,098,378 A 8/2000 Wyatt

* cited by examiner 10
62
64
58
6
60
2
115
100
102
110
I
104
4
108
H
104
108
I
14
84
100
68
80
H
102
82
69
54
46
68
103
63
65
68
82
69
80
68
20
16
26
24
31
30
28
32
22
12
30
24
18
142
26
24
31
30
28
32
22

6
8
2
14
58
60
100
104

METHOD AND APPARATUS FOR COMPRESSING A MATTRESS WITH AN INNER COIL SPRING

BACKGROUND

Devices and methods are known for packaging resiliently compressible articles, such as mattresses, cushions, foam pads, and the like, for storage and/or shipping purposes. Substantial space can be gained in connection with storing and transporting resilient articles by packaging the articles in a compressed and/or rolled up configuration.

The known state of the art includes different types of mattress furling machines. These devices have a center mandrel and one or more pressure rollers. A mattress, together with one end of a long strip of film, are fed through a gap between the mandrel and a pressure roller. The mattress is flattened by the pressure applied by the pressure roller as mattress and plastic film is coiled around the mandrel. When the mattress is completely drawn in, strips of adhesive tape are applied at several points onto the plastic film and are rolled up with the mattress as coiling continues. The plastic film is then cut off and coiling continues over a given length of adhesive tape, without any plastic film, before the strips of adhesive tape are cut as well. Upon completion of the coiling process, the mandrel is withdrawn from the center of the coil.

Furling machines, however, may suffer from several disadvantages. During the coiling process, the mandrel pulls the bottom side of the mattress while it rotates, with the upper side being squeezed and flattened in one direction. Consequently, the joining fabric between the two quilted plates forming the upper and bottom sides of the mattress is subjected to considerable strain. In addition, the mattress may be damaged while withdrawing the mandrel from the center of the coil or soiled by the hydraulic oil necessary to keep the moving parts of the mandrel operative.

Further, the design of a typical spring mattress does not lend itself to being packaged in a rolled-up configuration. In particular, the ends of the side border wires in a conventional mattress may poke through or otherwise damage the adjacent fabric covering if such a mattress is coiled onto itself.

The background section of U.S. Pat. No. 5,934,041 mentions that soft foam mattress pads without a coil spring have been vacuum packaged with the foam pad initially being hermitically sealed in a plastic bag with a slot. In this approach, a flattening press compresses the foam mattress with the slot being positioned where a vacuum hose rests. The press applies pressure as the vacuum is created to compress the foam mattress. As the press returns to a home position, the slot is sealed by adhesive tape so that the foam mattress remains compressed. The foam mattress is then rolled up in some undisclosed manner and put into a tubular film bag which is then sealed by tape, wire or hot sealing.

A need exists for an improved apparatus and method for packaging resiliently compressible articles, such as mattresses as well as a spring mattress having an improved border support to facilitate rolling of the mattress.

SUMMARY

The present invention is directed toward new and non-obvious aspects and features of an apparatus for packaging resiliently compressible articles, both alone and in various combinations and sub-combinations with one another. In addition, the invention is directed toward to new and non-obvious method acts and/or steps relating to compressing resiliently compressible articles in various sub-combinations. The present invention is also directed toward new and non-obvious aspects and features of a spring mattress, both alone and in combination with one another. These new and non-obvious aspects, features, acts and/or steps and combinations and sub-combinations thereof are set forth in the claims below.

According to one embodiment, an apparatus for packaging a resiliently compressible article has at least two rotatable, spaced apart article engagers or grippers adapted to receive an end portion of an article to be packaged. The article engagers or grippers may comprise hand portions which desirably have a rotation axis about which the hand portions are rotatably operable to roll the article into a compact rolled-up configuration when it is received by the hand portions.

In one specific embodiment, each hand portion has at least one article engaging member, such as a finger, for engaging a top surface of an end portion of the article and at least one article engaging member, such as a finger, for engaging a bottom surface of the end portion of the article. In addition, at least one of the hand portions can be adapted so as to be retractable in a direction away from the article, such as along the rotation axis of the hand portions, to release the article upon completion of the rolling process.

Each gripper, such as each hand portion, can be rotatably mounted to a respective one of first and second spaced apart gripper supports, which may take the form of respective arm portions spaced apart a sufficient distance to accommodate the positioning of the article therebetween. The arm portions can be pivotally mounted to the apparatus to permit pivoting of the arm portions about a pivot axis as the article is rolled. In a particular embodiment, for example, the arm portions are mounted to a support shaft, the pivoting of which causes pivoting of the arm portions. Alternatively, the arm portions may free-float about respective pivots, which may be along a common transverse axis such that, as the diameter of the article increases during rolling, the arms pivot to accommodate the increased diameter. Other upwardly and downwardly movable gripper supports may be used.

In addition, at least one of the gripper supports or arm portions can be adapted to be movable in a lateral direction (i.e., in a direction parallel to the rotation axis of the hand portions) to vary the space between the arm portions to accommodate articles of different widths. In one illustrated embodiment, one of the arm portions movable along a laterally extending support shaft, and may be slidable along the shaft, to permit such lateral movement of the arm portion and vary the spacing between arm portions. Also, an arm locking mechanism can be provided to lock the movable arm portion at a desired position relative to the other arm portion and prevent lateral movement when the apparatus is being used to roll an article.

Optionally, the apparatus may also be provided with a vacuum hose fluidly connected to a vacuum source for vacuum packing an article before it is rolled-up. The vacuum source may be, for example, a dedicated vacuum pump or a house vacuum system. In either case, the article to be packaged is typically placed in an air impervious enclosure. The nozzle of the vacuum hose is inserted into an opening of the enclosure to evacuate air therefrom. Consequently, atmospheric air acting on the outside of the enclosure will cause the article to compress to a reduced thickness.

The article may then be rolled by the apparatus up into a compact rolled-up configuration. Fluid connection may be maintained between the enclosure and the vacuum source to maintain the vacuum and the article in its compressed state while being rolled up, such as by rotating the hand portions as previously described. Upon completion of the rolling of the article, a restraint, such as an outer cover, which may be in the form of a plastic sleeve, may be placed over the article. The sleeve may be slipped over the article from one of the arm portions while the article is still engaged by the hand portions in one specific approach. The vacuum source can be disconnected from the enclosure (e.g., removing the vacuum hose) to allow air to flow into the enclosure to cause the article to expand to fit snugly in the outer cover.

A spring mattress having an improved border or edge support is also disclosed. According to one embodiment, the spring mattress comprises plural rows of springs extending between the ends of the mattress. Upper border wires extend around the periphery of the end portions of the upper surface of the mattress and have inwardly extending end portions. Lower border wires extend around the periphery of the end portions of the lower surface of the mattress and have inwardly extending end portions. Consequently, the inwardly projecting end portions of the border wires facilitate rolling of the mattress without causing damage to the fabric covering of the mattress.

DETAILED DESCRIPTION

Figure 1:
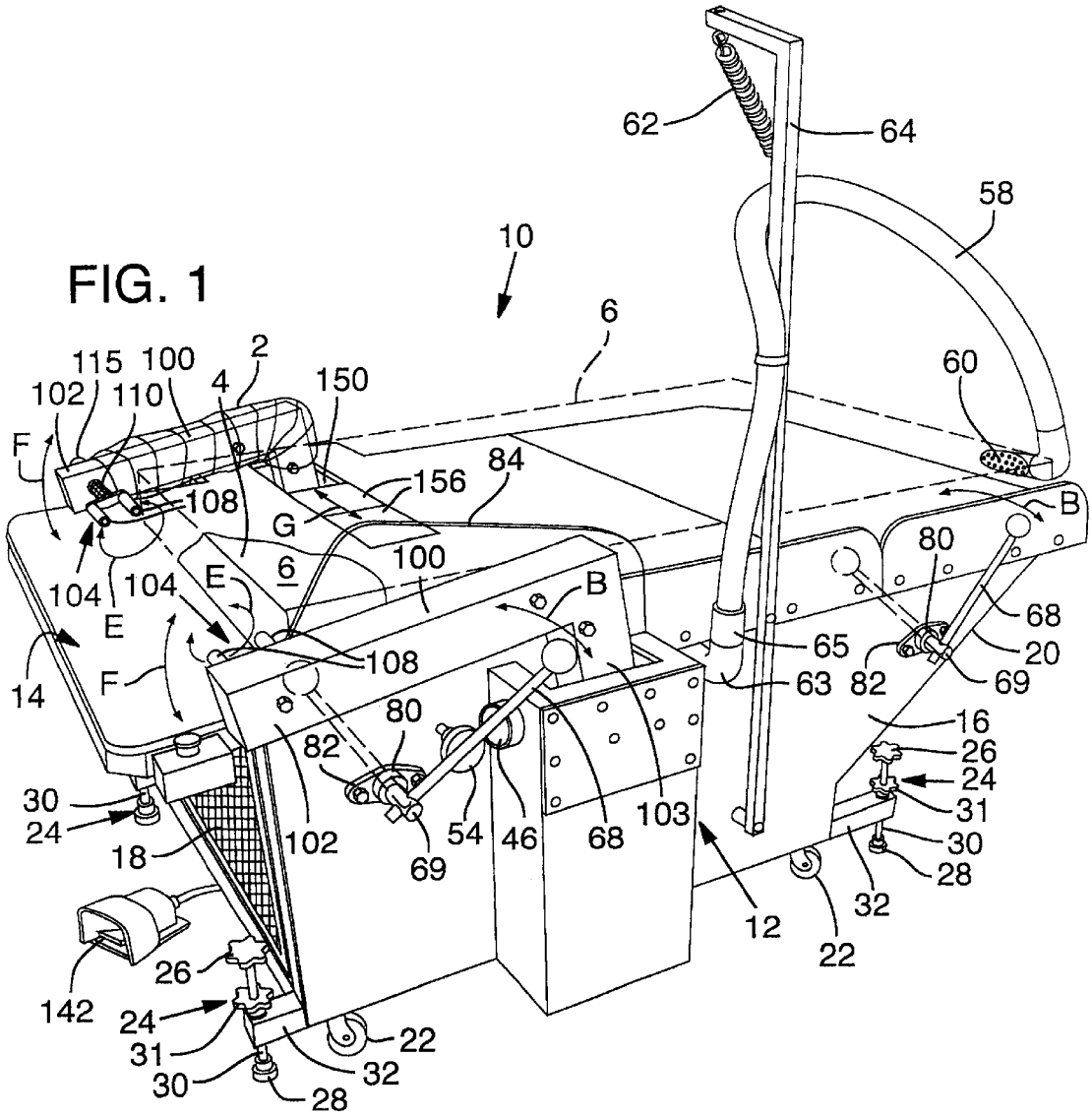
FIG. 1 is a perspective view of an apparatus for packaging a mattress, wherein the mattress is shown by dashed lines resting on the apparatus in preparation of being packaged.
Figure 2:
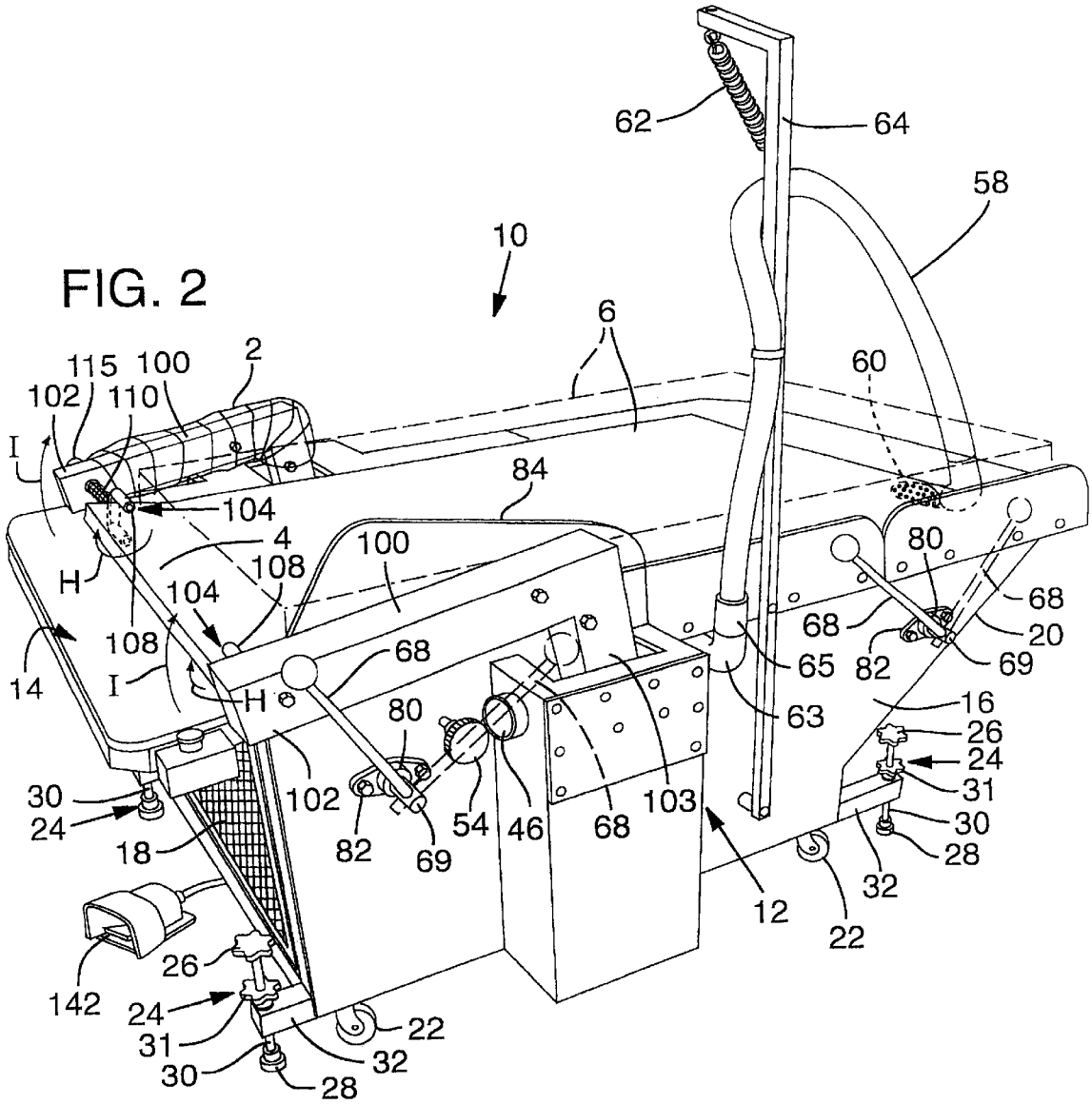
FIG. 2 is a perspective view of the apparatus of FIG. 1 showing the mattress in a compressed state in solid lines upon evacuation of air from the enclosure containing the mattress and the previous uncompressed state in dashed lines.
Figure 3:
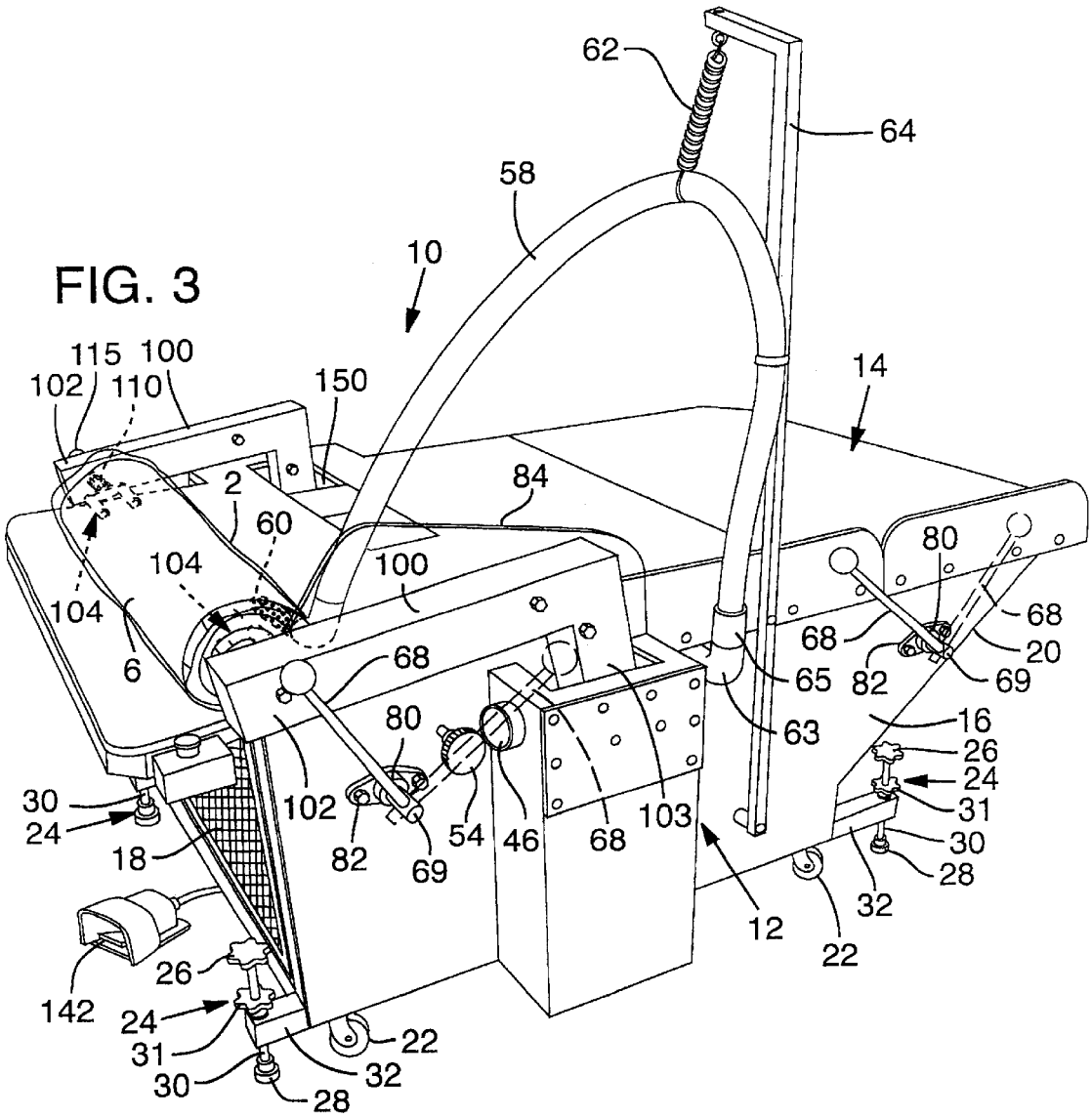
FIG. 3 is a perspective view of the apparatus of FIG. 1 showing the mattress after it has been rolled-up.

Referring first to FIGS. 1–3, one form of an apparatus 10 is shown for rolling up a resilient article such as a coil spring containing mattress 6. Although the following description of the apparatus 10 proceeds with reference to a most desirable application in connection with a spring containing mattress, the apparatus 10 may be used to package other resiliently compressible articles, such as cushions, foam pads or other mattress-like articles. As will be described in more detail below, in one approach the apparatus 10 is operable to package the mattress 6 in an essentially two act process wherein the mattress is first treated by vacuum packaging (FIG. 2) and then rolled into a compact rolled-up configuration (FIG. 3).

The apparatus 10 in the form shown comprises an enclosure or cabinet 12 having a top support surface 14 for supporting the mattress 6. The illustrated cabinet also has respective side panels 16, a front panel 18 and a back panel 20. A safety guard or shield 84 is desirably mounted to one of the side panels 16. The cabinet 12 is desirably mounted on casters 22 for moving the apparatus 10. Each of the casters may have a suitable locking mechanism (not shown) to prevent rolling of the apparatus once it is set in place for use.

The apparatus 10 may also be equipped with levelers 24, for example at each bottom corner of the cabinet 12, for adjusting the height of the apparatus and/or leveling the apparatus. In the illustrated form, each of the levelers 24 comprises a bolt 30 threaded into a locking nut 31 and carried by an outwardly projecting frame portion 32 of the cabinet 12. An adjustment knob 26 is secured to the top of the bolt 30 and a floor pad 28 is secured to the bottom end of the bolt 30. An operator can raise the apparatus at each corner by loosening lock nut 31 and turning the adjustment knob 26 of the appropriate leveler 24 in one direction, or alternatively, lower the apparatus by turning the adjustment knob 26 in the opposite direction. The locknut 31 may then, for example, be tightened.

Figures 10, 11, 12, 13, 14, 15, 16, 17, 18:
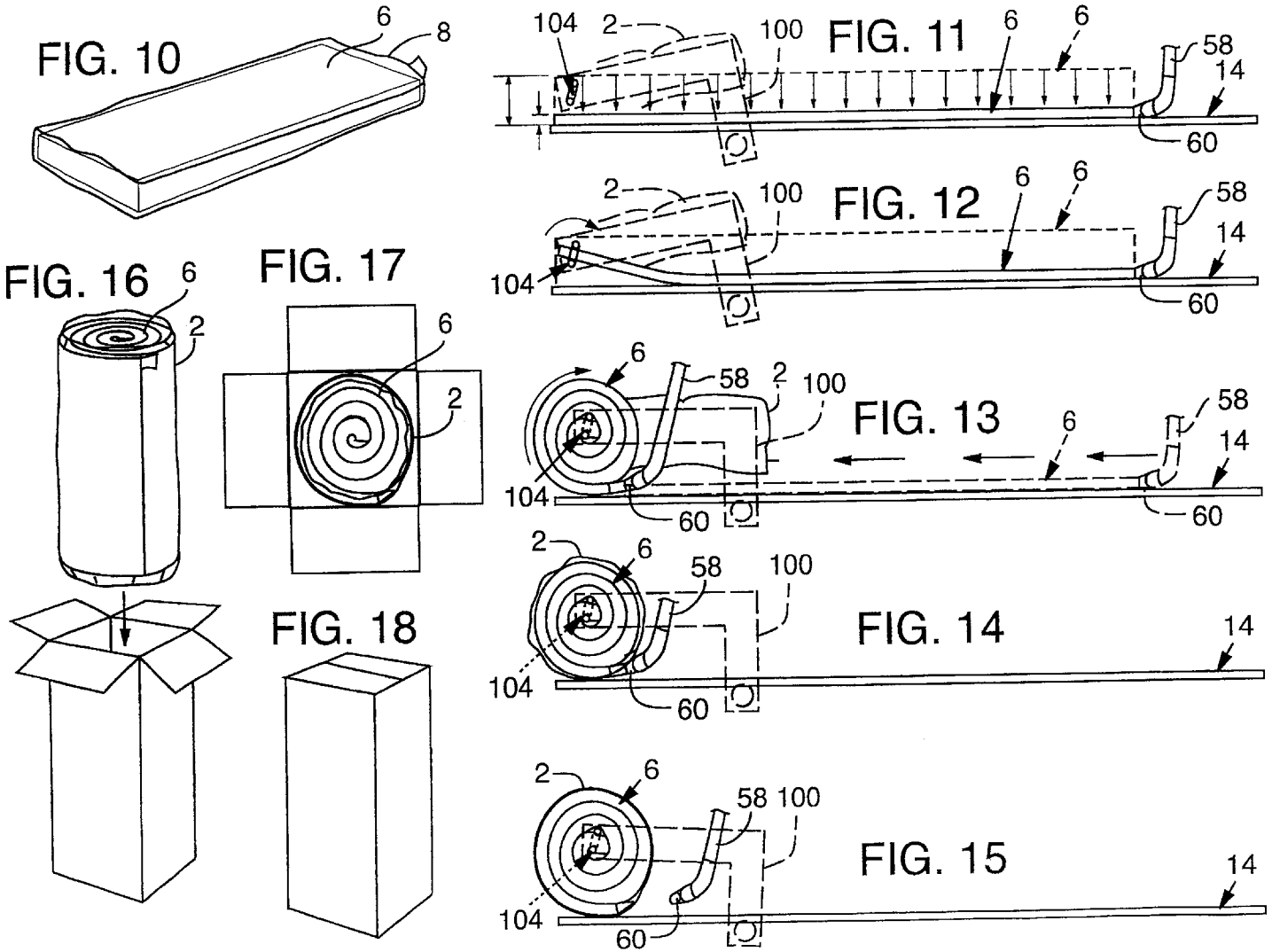
FIG. 10 is a perspective view of a mattress enclosed in a plastic wrapper before it is further packaged such as with the apparatus of FIGS. 1–9.
FIGS. 11–15 are schematic side views illustrating various stages of one approach for packaging of a mattress such as with the apparatus of FIGS. 1–9.
FIGS. 16–18 illustrate acts of placing the rolled-up mattress in a box for shipping.

Before a vacuum is used to compress the mattress 6, and typically before the mattress is placed on the support surface 14 of the apparatus 10 for packaging, it may be first inserted into a flexible, air impervious enclosure 8 (as can be seen in FIG. 10). The enclosure 8 enables the creation of a vacuum in the enclosure to thereby compress the mattress. The enclosure 8 may comprise, for example, a sealed plastic envelope or wrapper.

Figure 5:
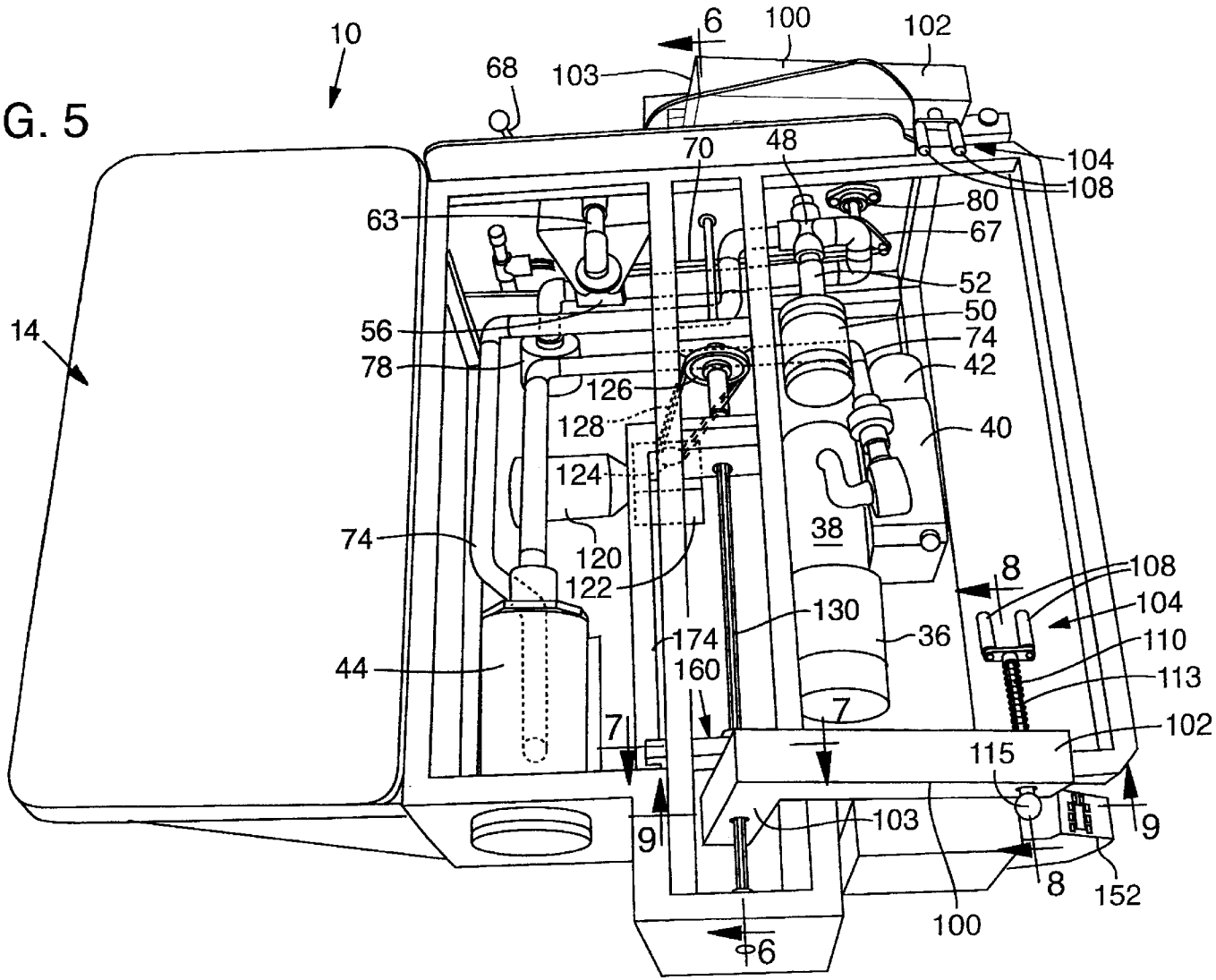
FIG. 5 is top perspective view of the apparatus of FIG. 1 with a portion of an article top support surface removed to show the inside of the cabinet.

In one approach for accomplishing the compression of the mattress 6, the illustrated apparatus 10 desirably includes a vacuum hose 58 connected to a vacuum source, such as a vacuum system 34 enclosed in the cabinet 12 (as shown in FIG. 5). Optionally, the vacuum hose 58 may be connected to a house vacuum system or other vacuum source, in which case a dedicated vacuum system is not required. In either case, to maintain the vacuum hose 58 in a convenient position above the mattress 6 during the packaging process, the vacuum hose 58 is desirably supported from above, such as by a coil spring 62, which is secured to the upper end of an upwardly extending support member. In one form, the support member comprises an elongated post 64 which may be attached to one side of the cabinet 12. The coil spring 62, in this example, is suspended from a support arm which projects from the post and over the support surface 14.

The vacuum hose 58 has a nozzle 60 that can be inserted into an opening in the enclosure 8. The illustrated nozzle is generally wedge shaped with a plurality of vacuum drawing apertures through one surface thereof. Enclosure 8 is typically folded or rolled around the nozzle to seal the enclosure, although tape or other sealing approaches may be used. When the nozzle is inserted and the enclosure is closed, the enclosure 8 is substantially hermetically sealed around the nozzle 60 to enable the creation of a vacuum in the enclosure. Thus, as air is removed from the enclosure, the mattress is compressed to a reduced thickness by atmospheric pressure acting on the outside of the enclosure (as shown in FIGS. 2 and 11). This can be accomplished without requiring a press and even though the mattress has a coil spring.

Alternatively, the mattress 6 can be compressed by other suitable methods or devices before it is positioned on the apparatus 10 for rolling. For example, although less desirable, the mattress, when inserted into an enclosure as described above, can be placed in a conventional flattening press to force air from the enclosure. The press may be used in combination with a vacuum source. In this case, the opening in the enclosure would have to be sealed or coupled to a vacuum source to maintain the mattress in its compressed state before it is transferred to the apparatus 10 for rolling. Still, in other cases, it may not be necessary to compress an article before it is positioned in the apparatus 10 for rolling. For example, the article to be packaged may be sufficiently thin in its normal, non-compressed state such that compression would not save any substantial space. Of course, in such a case, the article would not have to be placed in an air impervious enclosure or otherwise hermetically sealed for compression.

Figure 4:
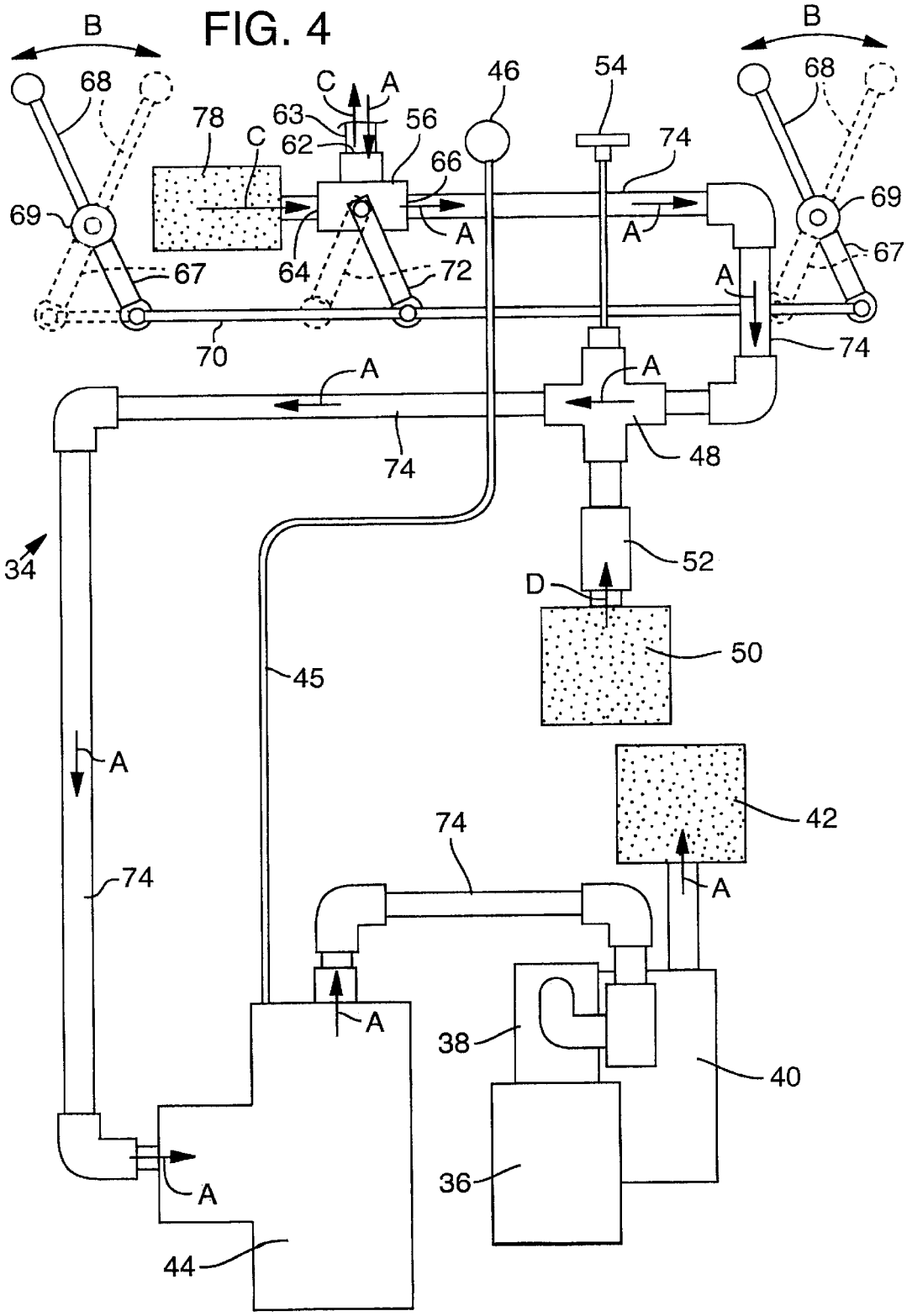
FIG. 4 is a schematic view of one exemplary form of a vacuum pump system for the apparatus of FIG. 1.

Referring to FIG. 4, an exemplary vacuum system 34 comprises a motor 36 coupled to a vacuum pump 38, which is connected by pipes 74 to a vacuum storage tank 44, a relief valve 48, and a three-way valve 56 for controlling the flow of air into the system 34. When the pump 38 is activated, air is drawn through the system in the direction of arrows A and into the pump, which feeds discharge air into an oil holding tank 40 and an outlet filter 42. In a working embodiment, the vacuum pump 38 is a model #4879-01 S/N 10204 vacuum pump manufactured by Plantronics of Walnut Creek, Calif. A vacuum gauge 46 can be connected to the vacuum storage tank 44 via tubing 45. As shown in FIG. 1, the vacuum gauge 46 is desirably mounted on the outside of the cabinet 12 for monitoring by an operator.

As illustrated, the three-way valve 56 has a first port 62 connected an inlet pipe 63, a second port 64 connected to an inlet filter 78 and a third port 66 connected to an outlet pipe 74. As shown in FIGS. 1–3, the inlet end 65 of the inlet pipe 63 is connected to the vacuum hose 58 so that air evacuated from the enclosure 8 is fed into the system 34.

The position of the three-way valve 56 may be controlled in any convenient manner, such as by a pair of levers 68, each of which is connected at its bottom end to a laterally extending shaft 69 (FIGS. 1–3). The shaft 69 of each lever 68, which extends through a side panel 16 of the cabinet 12, is supported by a bearing 80 and bearing bracket 82 mounted to the outside surface of the side panel 16. As shown in FIG. 4, lever extensions 67 are connected to the ends of each shaft 69 inside the cabinet 12. The bottom ends of extensions 67 are coupled together by a linkage 70, which is operatively connected to the valve 56 by another linkage 72. Thus, pivoting of either or both of the levers 68 about the longitudinal axis of their respective shafts 69 (as indicated by double-headed arrows B), causes the linkage 72 to move a positioner (not shown) in the valve for controlling the direction of air flow through the valve 56.

For example, pivoting the levers 68 to the left (as shown in solid lines in FIG. 4) may cause the positioner to close port 64 and open port 66. In this position, the vacuum pump 38 is fluidly connected to the enclosure 8 containing the mattress 6 so that when activated, the vacuum pump 38 evacuates air from the enclosure to compress the mattress 6. Pivoting the levers 68 to the right (as shown in dashed lines in FIG. 4) may cause the positioner to close port 66 and open port 64 so that the vacuum pump 38 is fluidly disconnected from the enclosure. Consequently, the sub-atmospheric pressure in the enclosure if this approach is used causes atmospheric air to be drawn in through inlet filter 78 and through the valve 56 in the direction of arrows C to re-pressurize the enclosure.

The vacuum relief valve 48 has an adjustment knob 54 for adjusting the relief setting of the valve 48. The adjustment knob is desirably positioned in a convenient location outside the cabinet 12 (such as shown in FIG. 1) to permit adjustment by an operator without having to access the valve 48 inside the cabinet. In normal operation, air flows through the relief valve 48 in the direction of arrow A (FIG. 4). However, if the vacuum downstream of the relief valve 48 exceeds the relief setting, the relief valve 48 opens to permit atmospheric air to be drawn into the system 34 through an inlet filter 50 and a check valve 52 in the direction of arrow D.

Referring again to FIGS. 1–3, the apparatus 10 includes at least two rotatable, article engaging or gripping elements, such as spaced apart hand portions 104, adapted to receive or engage an end portion 4 of the mattress 6 for rolling the mattress 6 into a compact rolled up configuration, desirably after the mattress is in its compressed state (FIG. 3). The article engagers may take any suitable form which desirably results in temporary gripping of the end portion of the mattress which is to become the center of the rolled up mattress during the rolling procedure. In the illustrated embodiment, each hand portion 104 comprises at least two spaced apart article engaging elements such as fingers 108 connected to a shaft 110 by a support 106. The fingers 108 may be of any suitable shape or cross-section, however, desirably they are of a circular cross-section. Also, more or less than two article engaging elements may be used. As best shown in FIG. 2, one of the article engaging fingers 108 of each hand portion 104, in the form shown, engages a top surface of an end portion of the mattress 6 and the other article engaging finger 108 engages a bottom surface of an end portion of the mattress 6 when an end portion 4 (FIG. 2) of the mattress 6 is positioned between the article engaging fingers of each hand portion.

Various other forms of article engaging elements may be used. Other examples, for example, comprise article engaging members otherwise configured to engage the opposing major side surfaces of an end portion of an article. Still alternatively, the fingers 108 of opposed hand portions may be interconnected so as to form elongated article engaging elements adapted to extend transversely across portions of the top and bottom surfaces of an end portion of an article.

Figure 8:
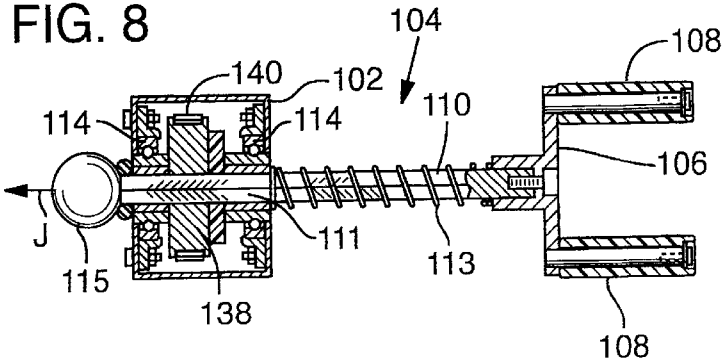
FIG. 8 is a cross-sectional view taken along line 8—8 of FIG. 5.

In the illustrated embodiment, each hand portion 104 is rotatably mounted by a respective shaft 110 to the first end 102 of a respective one of at least two spaced apart, L-shaped arm portions 100. As shown in FIG. 8, the end portion 111 of each shaft 110 is supported by bearings 114 secured to the inside of the associated arm portion 100. The shaft 110 may be slidable relative to the bearings 114 along its longitudinal axis. Typically only one hand portion and shaft is slidable in this manner. In FIG. 8, the slidable shaft carries a spring 113 to bias the hand portion 104 away from the associated shaft supporting arm and toward the side of the mattress 6. In this example, an operator can retract the hand portion 104 toward its associated supporting arm and away from the mattress by pulling on a knob 115 connected to end portion 111 in the direction of arrow J. When moved in this direction, the fingers 108 disengage from the rolled up mattress to facilitate removal of the rolled mattress from the apparatus.

Figure 6:
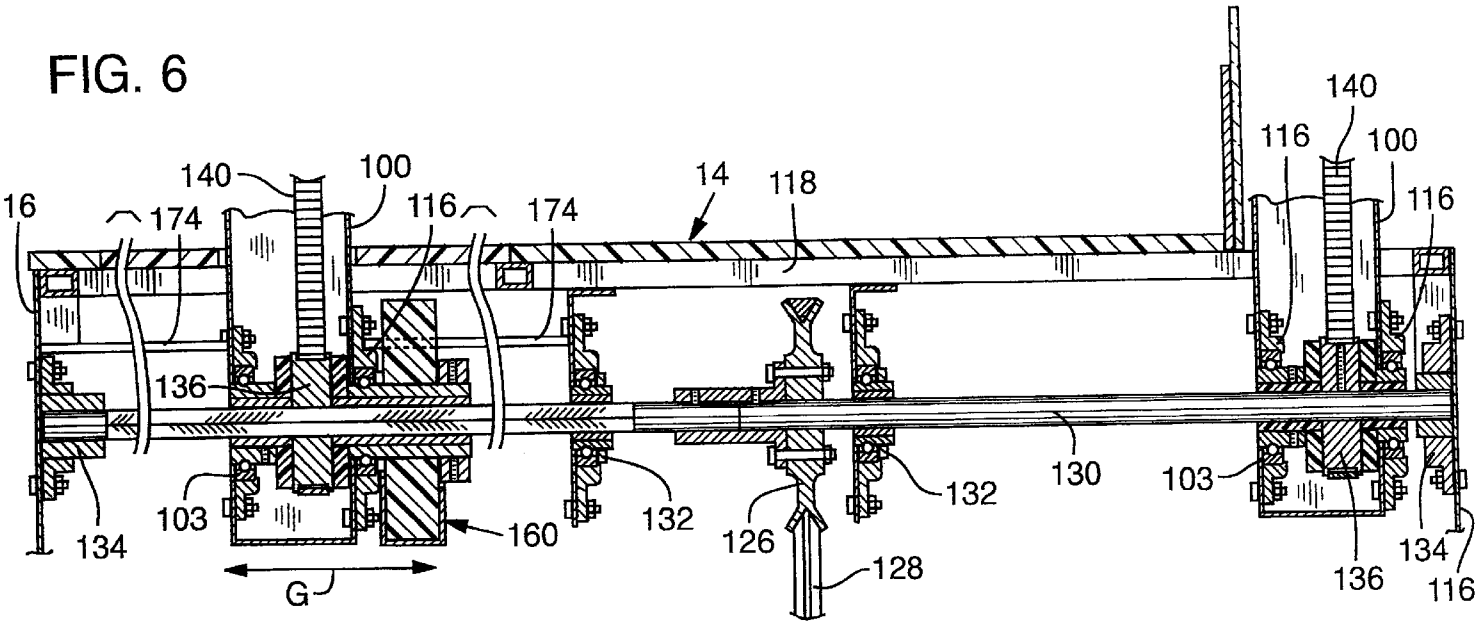
FIG. 6 is a fragmentary, cross-sectional view taken along line 6—6 of FIG. 5.

The arm portions are desirably mounted to the apparatus in such a manner so as to permit pivoting of the arm portions about a pivot axis as the article is rolled. Thus, for example, the arms can move upwardly relative to table surface 14 as the mattress is rolled and the rolled portion of the mattress increases in diameter. In addition, at least one, or both, of the arm portions can be adapted to be movable in a lateral direction (i.e., in a direction parallel to the rotation axis of the hand portions) to vary the space between the arm portions to accommodate articles of different widths. In the illustrated embodiment, for example, an arm carrier, such as a shaft 130, extends through the second end 103 of each arm portion 100 and is coupled respectively at each end by bearings 134 to the inside surfaces of side panels 16 or to the frame of the cabinet 12 (as shown in FIG. 6). The shaft 130 may also be supported near its center by bearings 132 secured to a support brace 118 extending between the side panels 16 of the cabinet. Bearings 116 secured to each arm portion 100 support the arm portions on the shaft 130 so as to permit pivoting of the arm portions 100 relative to the shaft 130 about its longitudinal axis (as indicated by double-headed arrows F in FIG. 1).

Various other mounting arrangements can be utilized for mounting the arm portions. For example, each arm portion can be mounted to a separate arm carrier. Alternatively, other upwardly and downwardly, e.g., vertically movable, article gripping member support assemblies may be used.

Figure 9:
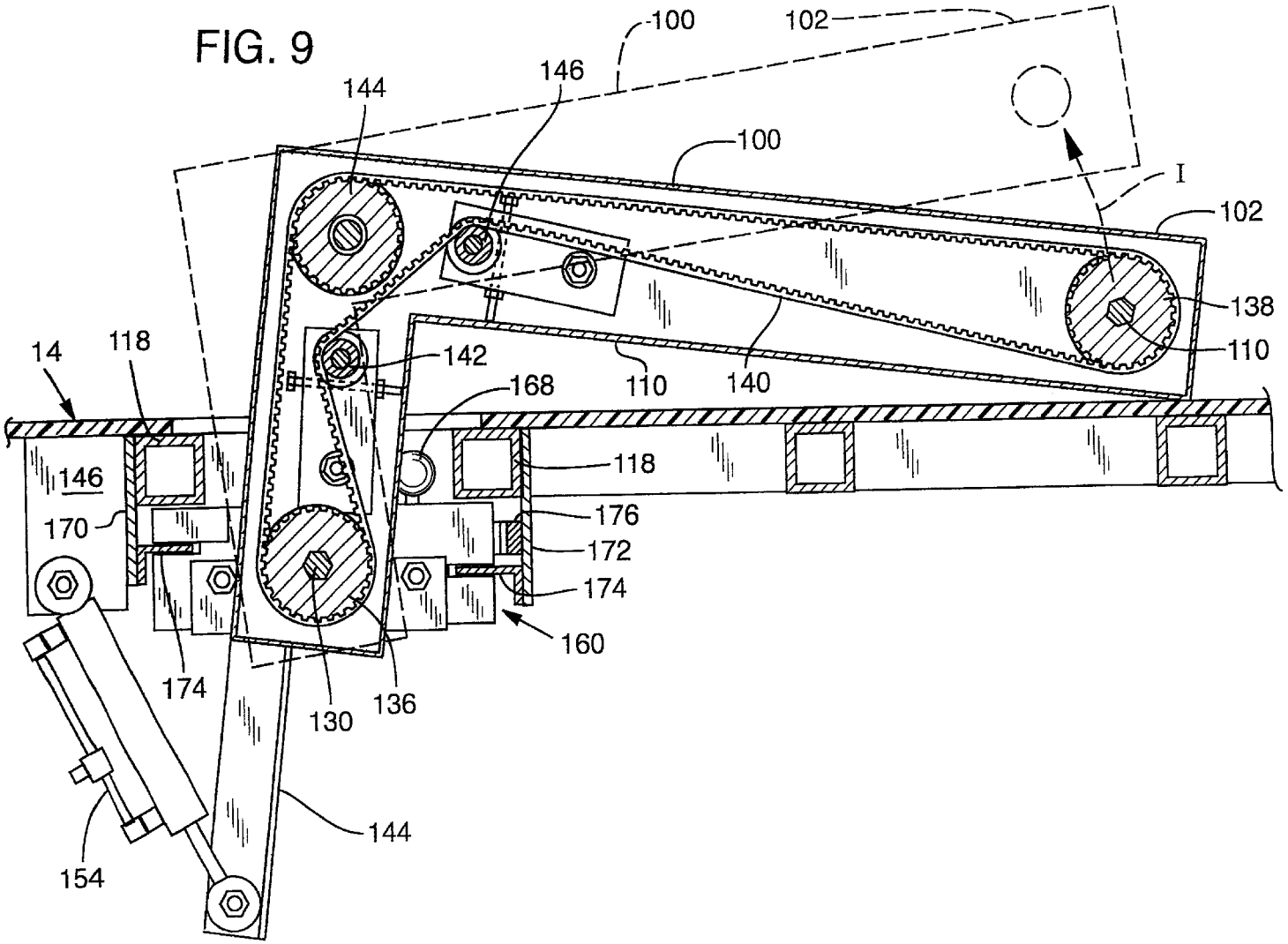
FIG. 9 is a fragmentary, cross-sectional view taken along line 9—9 of FIG. 5.

As shown in FIG. 9, shaft extension 144 may be connected to the second end 103 of each arm portion 100. A shock absorber 154 may be connected at one end to the bottom end of each of the extensions 144 and at its other end to a bracket 146 positioned at the underside of the support surface 14.

As mentioned above, at least one of the arm portions can be adapted to be movable in a lateral direction (i.e., in a direction parallel to the rotation axis of the hand portions). In one approach, as best shown in FIG. 1, at least one of the arm portions 100 may extend through a laterally extending slot or opening 150 to allow for lateral movement of that arm portion 100 along the shaft 130 (as indicated by double-headed arrow G in FIGS. 1 and 6) to vary the spacing between the arm portions 100. As a result, when this desirable option is included, the spacing between arm portions 100 may be varied to accommodate articles of different widths. In this particular embodiment, the portion of the shaft 130 upon which one of the arm portions is movable relative thereto may have flat surfaces and the remaining portion of the shaft may be rounded (FIG. 6). Removable closure panels 156 can be placed over the opening 150 once the proper spacing between arm portions is set.

Figure 7:
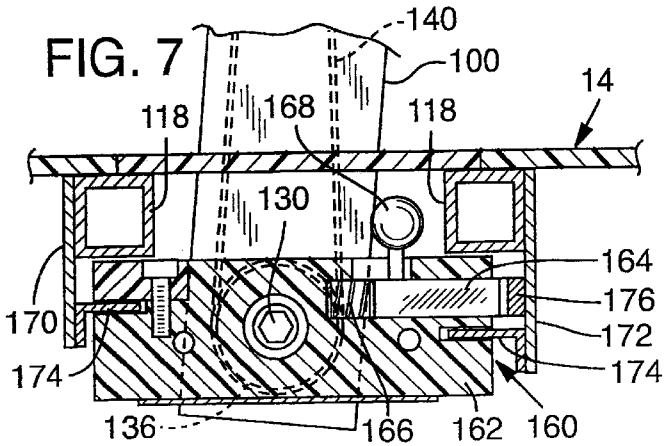
FIG. 7 is a fragmentary, cross-sectional view taken along line 7—7 of FIG. 5.

When an arm portion is adapted for such lateral movement, an arm locking mechanism can be provided to lock or maintain the arm portion at a desired position relative to the other arm portion once the proper spacing between arm portions is set. As shown in FIG. 7, for example, an arm portion adapted for lateral movement in one form is equipped with an arm locking mechanism 160 to lock the arm portion at a desired position along the length of the shaft 130. An operator can access the arm locking mechanism 160 inside the cabinet 12 by removing one or more of the panels 156.

The locking mechanism 160 in the form shown comprises a body 162 mounted to or carried by the arm portion. The body 162 has slots which respectfully slidably engage a pair of laterally extending horizontal plates 174 attached to laterally extending brackets 170 and 172 which are secured to the underside of the support surface 14 by support braces or frame elements 118. A pin 164 and a biasing spring 166 are received in a bore defined in the body 162. The spring 166 biases the pin 164 outwardly to be received in one of a plurality of notches defined between teeth 176 positioned along the length of the bracket 172. Thus, when the pin 164 engages a notch, the arm portion is prevented from sliding relative to the shaft 130. A knob 168 is attached to the pin 164 for gripping by an operator to retract the pin 164 out of a notch to permit adjusting the position of the arm portion along the shaft 130.

The apparatus 10 is desirably equipped with at least one drive mechanism for driving the hand portions 104 for rolling the mattress 6. In the illustrated embodiment, for example, an electric motor 120 for driving the hand portions 104 may be mounted in the cabinet 12. The shaft of the motor 120 (not shown) may be coupled to the input shaft of a right-angle gearbox 122. A drive transfer mechanism such as a V-belt 128 passes over a driving pulley 124 mounted on the output shaft of the gearbox 122. The belt 128 also passes over a driven pulley 126 mounted on the shaft 130 to transmit rotation of the output shaft of the gearbox to the shaft 130 (FIGS. 5 and 6). Mounted to the shaft 130 within each arm portion 100 is a driving pulley 136 (FIGS. 6, 7 and 9). A drive transfer mechanism such as a grooved belt 140 passes at least partially around the driving pulley 136 and a driven pulley 138 mounted on the shaft 110 of the hand portion 104 to transmit rotation of the shaft 130 to the hand portion 104 (FIG. 9). The belt 140 also passes over idling pulleys 142, 144 and 146, mounted to the inside of the arm portion 100.

Thus, it is seen that the motor 120 causes rotation of the hand portions 104 about the longitudinal axes of their shafts 110 in the direction indicated by arrows H in FIG. 2 to roll the mattress 6. As shown in FIGS. 1–3, a foot pedal 142 for turning on and off the motor 120 is electrically connected to the motor 120. Optionally, a selector switch (not shown) electrically connected to the motor 120 may be provided to reverse the rotation of the motor 120 and therefore reverse the rotation of the hand portions 104. In addition, a variable speed drive 152 (FIG. 5), such as an AC inverter, may be electrically connected to the motor 120 to allow an operator to vary the rotational speed of the hand portions 104.

Of course, other types of drive mechanisms or plural drive mechanisms can be used to drive the hand portions. For example, each hand portion can be provided with its own motor, which can, for example, be carried by the associated arm portion. The hand portions could also be adapted to be pneumatically or hydraulically driven or driven by human power (e.g., by turning a hand crank). Further, although both hand portions 104 are driven by the motor 120 in the illustrated embodiment, less desirably it would also be possible to roll the mattress by driving only one of the hand portions 104.

A method for packaging a mattress with the apparatus 10 is illustrated in FIGS. 10–18. As previously described, the mattress is first placed in an air impervious enclosure (FIG. 10). An outer cover 2, such as a sleeve or other expansion restrictor, plastic tubular sleeve being a specific example, is placed on one of the arm portions 100 and mattress is positioned between the hand portions 104. The nozzle 60 of the vacuum hose 58 is inserted into an opening of the enclosure 8 and the vacuum pump is activated to compress the mattress (FIG. 11). The mattress is then rolled up with the vacuum hose 58 connected to the enclosure 8 to maintain the mattress in its compressed state (FIGS. 12–13). Once the mattress 6 has been rolled, the outer cover 2 is pulled or placed over the coiled mattress 6 (FIG. 14). After this, the vacuum hose 58 is removed from the enclosure to cause the mattress to expand to fit snugly in the outer cover 2 (FIG. 15). Other expansion restrictors, such as tape or ties for example, may be used, but the illustrated sleeve approach is fast and convenient. The mattress is removed from the hand portions 104 (e.g., by retracting one of the hand portions away from the mattress) and inserted into a cardboard box (FIGS. 16–18).

Figure 19:
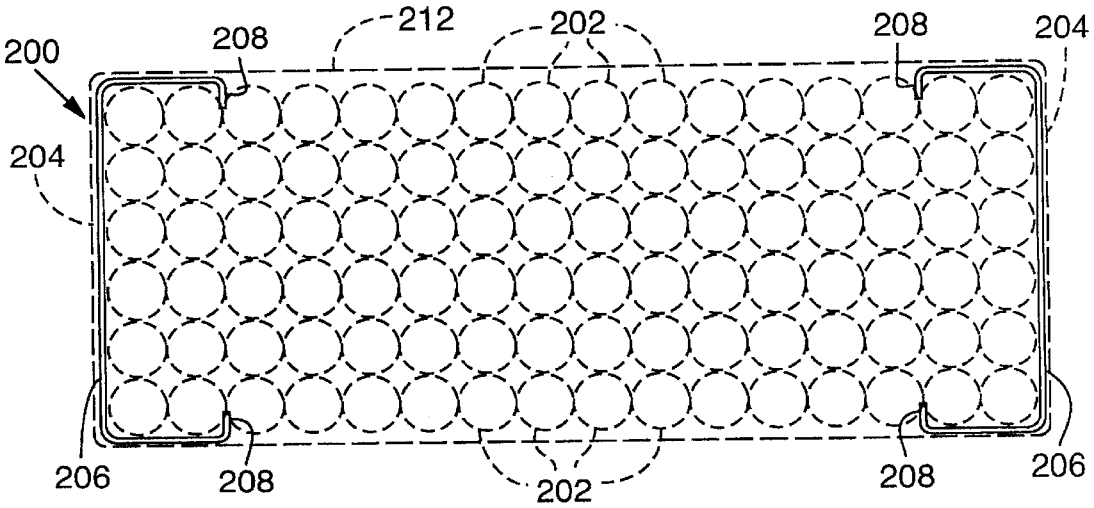
FIG. 19 is a top plan view of the inside of one embodiment of a mattress spring for a spring mattress adapted for rolling up.
Figure 20:
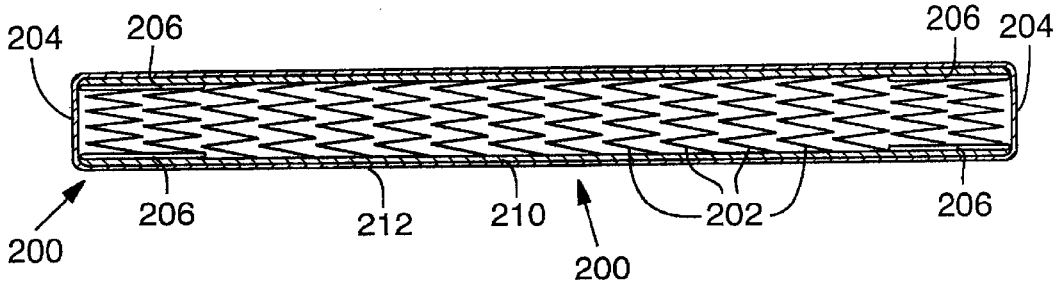
FIG. 20 is a vertical sectional view of one form of a mattress with a spring of the type shown in FIG. 19.

Referring to FIGS. 19 and 20, there is shown a spring mattress 200 which comprises a coil spring core having plural rows of coil springs 202 extending between the ends 204 of the mattress. Upper and lower border reinforcers such as wires 206 extend around the periphery of the end portions and a portion of each side of the upper and lower surfaces of the mattress, respectively. As shown in FIG. 19, the end portions 208 of respective legs of each border wire 206 are bent inwardly such as, for example, to extend between the second and third row of springs 202 from the corresponding end 204 of the mattress. The legs of each border wire extend from a cross-piece which spans the end of the mattress and toward the opposite side of the mattress. In an exemplary working embodiment, the border wires 206 are substantially C-shaped and comprise nine gauge wire having a diameter of about 0.15 inch with 0.1483 of an inch being a specific example and the coils of the spring comprise thirteen gauge wire having a diameter of about 0.9 inch with 0.0915 of an inch being a specific example. The coils may be of a generally hour glass shape with the largest cross-sectional dimension at the top and bottom of the respective coils. Also, lacing wire (sometimes called a helical) interties the coils. As one example, seventeen gauge (0.05 inch) lacing wire may be used. As shown in FIG. 20, a foam pad or layer 210 overlies the top and bottom of the spring core. Desirably, the foam pad is an open cell polyurethane foam such as 1.5 lb. density foam which is one and one-fourth inch thick. In experimentations, 1.2 lb. density foam and one inch thick foam produced less desirable results when the mattress with the above described spring was collapsed applying a vacuum and rolled up. Thus, a desirable example is an open celled foam of a density which is greater than 1.2 lb. density and more specifically at least 1.5 lb. density, and is at greater than one inch thick and more specifically at least one and one-fourth inch thick. An upholstered fabric covering 212 encases the mattress 200.

The construction of the mattress 200 is advantageous in that the border wires, with their inwardly extending end portions 208, permit rolling of the mattress while minimizing the risk of the ends of the wire supports 208 poking through and causing damage to the fabric covering of the mattress.

The present invention has been shown in the described embodiments for illustrative purposes only. The present invention may be subject to many modifications and changes-without departing from the spirit or essential characteristics thereof. We therefore claim as our all such modifications as come within the spirit and scope of the following claims.

We claim:

1. An apparatus for packaging a resiliently compressible article having a top surface, a bottom surface, opposing side surfaces and opposing end portions, the apparatus comprising:

at least two rotatable, spaced apart article engaging members each comprising respective first and second spaced apart article graspers for receiving and engaging the top and bottom surfaces of the article at an end portion of the article, the first and second article graspers being rotatable about a rotation axis which is spaced from the first and second article graspers, the article being rolled up about the rotation axis upon rotation of the article engaging members;

an article engaging member rotator coupled to at least one of the article engaging members and operable to selectively rotate the at least one of the article engaging members; and wherein the first and second article graspers rotate to roll the article into a compact rolled-up configuration about the rotation axis when the first and second article graspers engage an end portion of the article and are rotated about the rotation axis.

2. The apparatus of claim 1 further comprising first and second of spaced apart article engaging member supports, each of which has a respective one of the article engaging members rotatably mounted thereto, the article engaging member supports carrying the article engaging members so as to permit movement of the rotation axis as the article is rolled up.

3. The apparatus of claim 2 further comprising a support surface for supporting the article.

4. The apparatus of claim 3 wherein the article engaging member supports each comprise a respective elongated pivot arm which is pivotally supported by a support arm pivot so as to pivot relative to the support surface about a transversely extending pivot axis, the article engaging members each being supported by a respective one of the pivot arms at a location spaced from the support arm pivot, the pivot arms pivoting upwardly to raise the rotation axis and move the rotation axis away from the support surface as the article is being rolled up by rotation of the article engaging members.

5. The apparatus according to claim 2 wherein the article comprises a mattress which contains a coil spring.

6. The apparatus according to claim 2 wherein the article engaging member rotator comprises at least one motor operable to selectively rotate at least one of the article engaging members to roll up the article.

7. An apparatus according to claim 1 wherein the resiliently compressible article comprises a resiliently compressible coil spring containing mattress enclosed in an air impervious enclosure, the mattress having a top surface, a bottom surface, opposing side surfaces, and opposing end surfaces and end portions, the apparatus further comprising:

a vacuum source for removing air from the enclosure to cause the mattress to compress;

the first and second article graspers comprising at least first and second mattress engaging members adapted to respectively engage respective end portions of the mattress, the mattress engaging members being rotatably supported and defining a rotation axis about which each mattress engaging member is rotated to roll the compressed mattress;

the mattress engaging members being supportable such that the position of the rotation axis is adjustable as the compressed mattress is rolled.

8. The apparatus of claim 7 wherein the vacuum source comprises a vacuum pump and a vacuum hose fluidly connected to the vacuum pump and having a nozzle end adapted to be inserted into the enclosure.

9. The apparatus of claim 7 including a housing and an upright support coupled to the housing to support the vacuum hose at a location above the elevation of the mattress being rolled.

10. An apparatus for packaging a resiliently compressible article having a top surface, a bottom surface, opposing side surfaces and opposing end portions, the apparatus comprising:

at least two rotatable, spaced apart article engaging members for receiving and engaging the top and bottom surfaces of the article at an end portion of the article, the article engaging members defining a rotation axis about which the article is rolled up upon rotation of the article engaging members;

an article engaging member rotator coupled to at least one of the article engaging members and operable to selectively rotate the at least one of the article engaging members; and wherein the article engaging members rotate to roll the article into a compact rolled-up configuration about the rotation axis when the article engaging members engage an end portion of the article and are rotated about the rotation axis; and wherein each article engaging member comprises at least one article engaging finger for engaging a portion of the top surface of the end portion of an article and at least one article engaging finger for engaging a portion of the bottom surface of the end portion of an article.

11. An apparatus for packaging a resiliently compressible article having a top surface, a bottom surface, opposing side surfaces and opposing end portions, the apparatus comprising:

at least two rotatable, spaced apart article engaging members for receiving and engaging the top and bottom surfaces of the article at an end portion of the article, the article engaging members defining a rotation axis about which the article is rolled up upon rotation of the article engaging members;

an article engaging member rotator coupled to at least one of the article engaging members and operable to selectively rotate the at least one of the article engaging members;

wherein the article engaging members rotate to roll the article into a compact rolled-up configuration about the rotation axis when the article engaging members engage an end portion of the article and are rotated about the rotation axis; and further comprising first and second of spaced apart article engaging member supports, each of which has a respective one of the article engaging members rotatably mounted thereto, the article engaging member supports carrying the article engaging members so as to permit movement of the rotation axis as the article is rolled up; and wherein at least one of the article engaging member supports is movable in a direction parallel to the rotation axis to accommodate articles of different widths.

12. An apparatus for packaging a resiliently compressible article having a top surface, a bottom surface, opposing side surfaces and opposing end portions, the apparatus comprising:

at least two rotatable, spaced apart article engaging members for receiving and engaging the top and bottom surfaces of the article at an end portion of the article, the article engaging members defining a rotation axis about which the article is rolled up upon rotation of the article engaging members;

an article engaging member rotator coupled to at least one of the article engaging members and operable to selectively rotate the at least one of the article engaging members; and wherein the article engaging members rotate to roll the article into a compact rolled-up configuration about the rotation axis when the article engaging members engage an end portion of the article and are rotated about the rotation axis;

further comprising first and second of spaced apart article engaging member supports, each of which has a respective one of the article engaging members rotatable mounted thereto, the article engaging member supports carrying the article engaging members so as to permit movement of the rotation axis as the article is rolled up; and wherein at least one of the article engaging members is retractable in a direction parallel to the rotation axis and away from the article to selectively release the article.

13. An apparatus for packaging a resiliently compressible article having a top surface, a bottom surface, opposing side surfaces and opposing end portions, the apparatus comprising:

at least two rotatable, spaced apart article engaging members for receiving and engaging the top and bottom surfaces of the article at an end portion of the article, the article engaging members defining a rotation axis about which the article is rolled up upon rotation of the article engaging members;

an article engaging member rotator coupled to at least one of the article engaging members and operable to selectively rotate the at least one of the article engaging members; and wherein the article engaging members rotate to roll the article into a compact rolled-up configuration about the rotation axis when the article engaging members engage an end portion of the article and are rotated about the rotation axis; and in which the article is positioned within an air impervious enclosure, the apparatus further comprising a vacuum source for removing air from the air impervious enclosure containing the article to compress the article without the use of an article press.

14. The apparatus of claim 13 wherein the vacuum source comprises a vacuum hose fluidly connected to a vacuum pump.

15. An apparatus for packaging a coil spring containing mattress, the mattress having a top surface, a bottom surface, opposing side surfaces, and opposing end portions, the apparatus comprising:

at least two opposing spaced apart arm portions for receiving the article therebetween with each side of the mattress being positioned adjacent a respective one of the arm portions; and a respective hand portion rotatably carried by each arm portion, the hand portions each being adapted to receive an end portion of the mattress at a respective side of the article, the hand portions together defining a rotation axis about which the article is rolled upon rotation of the hand portions with the article received by the hand portions; and a hand portion rotator coupled to at least one of the hand portions and adapted to selectively rotate the coupled hand portion about the rotation axis to roll up the mattress.

16. The apparatus of claim 15 wherein at least one of the hand portions is adapted for retraction in a direction parallel to the rotation axis and away from the mattress to release the mattress after it has been rolled-up.

17. The apparatus of claim 15 wherein the arm portions are supported on a shaft extending in a direction generally parallel to the rotation axis.

18. The apparatus of claim 17 wherein at least one arm portion movably engages the shaft for movement of the arm portion to different positions along the shaft to accommodate articles of different widths.

19. The apparatus of claim 18 further comprising an arm locking mechanism for selectively locking the at least one arm portion at positions to which it has been moved along the shaft.

20. The apparatus of claim 17 wherein the shaft is rotatable about its longitudinal axis to pivot the arm portions about the longitudinal axis of the shaft.

21. An apparatus for packaging a coil spring containing mattress, the mattress having a top surface, a bottom surface, opposing side surfaces, and opposing end portions, the apparatus comprising:

at least two opposing spaced apart arm portions for receiving the article therebetween with each side of the mattress being positioned adjacent a respective one of the arm portions; and a respective hand portion rotatably carried by each arm portion, the hand portions each being adapted to receive an end portion of the mattress at a respective side of the article, the hand portions together defining a rotation axis about which the article is rolled upon rotation of the hand portions with the article received by the hand portions; and a hand portion rotator coupled to at least one of the hand portions and adapted to selectively rotate the coupled hand portion about the rotation axis to roll up the mattress; and wherein each hand portion comprises at least one article engaging finger for engaging a top surface of the end portion of the mattress and at least one article engaging finger for engaging a bottom surface of the end portion of the mattress.

22. An apparatus for packaging a resiliently compressible article having a top surface, a bottom surface, opposing side surfaces and opposing end portions, the apparatus comprising:

at least two rotatable, spaced apart article engaging members for receiving and engaging the top and bottom surfaces of the article at an end portion of the article, the article engaging members being operable to engage the top and bottom surfaces of the article at an end portion of the article and adjacent to the respective side surfaces of the article without extending across the entire top surface of the article between the side surfaces thereof, the article engaging members defining a rotation axis about which the article is rolled up upon rotation of the article engaging members;

an article engaging member rotator coupled to at least one of the article engaging members and operable to selectively rotate the at least one of the article engaging members; and wherein the article engaging members rotate to roll the article into a compact rolled-up configuration about the rotation axis when the article engaging members engage an end portion of the article and are rotated about the rotation axis.

23. An apparatus according to claims 22 in combination with the article being rolled up and wherein the article comprises a coil spring.

* * * * *